US006017115A

United States Patent [19]

Bern

[11] Patent Number: 6,017,115

[45] Date of Patent: Jan. 25, 2000

[54] DIRECT PRINTING METHOD WITH IMPROVED CONTROL FUNCTION

[75] Inventor: Bengt Bern, Mölndal, Sweden

[73] Assignee: Array Printers AB, Sweden

[21] Appl. No.: 08/871,817

[22] Filed: Jun. 9, 1997

[51] Int. Cl.[7] ..... G05G 15/08; B41J 2/04

[52] U.S. Cl. ..... 347/54; 399/261

[58] Field of Search ..... 347/54, 55, 120, 347/123, 111, 159, 141, 151, 127, 128, 17, 103, 154, 20, 84, 85; 399/288, 261

[56] References Cited

U.S. PATENT DOCUMENTS

| | | |
|---|---|---|
| 3,566,786 | 3/1971 | Kaufer et al. . |
| 3,689,935 | 9/1972 | Pressman et al. . |
| 3,779,166 | 12/1973 | Pressman et al. . |
| 3,815,145 | 6/1974 | Tisch et al. . |
| 4,263,601 | 4/1981 | Nishimura et al. . |
| 4,274,100 | 6/1981 | Pond . |
| 4,353,080 | 10/1982 | Cross . |
| 4,382,263 | 5/1983 | Fischbeck et al. . |
| 4,384,296 | 5/1983 | Torpey . |
| 4,386,358 | 5/1983 | Fischbeck . |
| 4,470,056 | 9/1984 | Galetto et al. . |
| 4,478,510 | 10/1984 | Fujii et al. . |
| 4,491,794 | 1/1985 | Daley et al. . |
| 4,491,855 | 1/1985 | Fujii et al. . |
| 4,498,090 | 2/1985 | Honda et al. . |
| 4,511,907 | 4/1985 | Fukuchi . |
| 4,525,727 | 6/1985 | Kohashi et al. . |
| 4,571,601 | 2/1986 | Teshima . |
| 4,675,703 | 6/1987 | Fotland . |
| 4,717,926 | 1/1988 | Hotomi . |
| 4,743,926 | 5/1988 | Schmidlin et al. . |
| 4,748,453 | 5/1988 | Lin et al. . |
| 4,814,796 | 3/1989 | Schmidlin . |
| 4,831,394 | 5/1989 | Ochiai et al. . |
| 4,837,071 | 6/1989 | Tagoku et al. . |
| 4,860,036 | 8/1989 | Schmidlin . |
| 4,903,050 | 2/1990 | Schmidlin . |
| 4,912,489 | 3/1990 | Schmidlin . |
| 5,028,812 | 7/1991 | Bartky . |

(List continued on next page.)

FOREIGN PATENT DOCUMENTS

| | | |
|---|---|---|
| 0345 024 A2 | 6/1989 | European Pat. Off. . |
| 0352 997 A2 | 1/1990 | European Pat. Off. . |
| 0377 208 A2 | 7/1990 | European Pat. Off. . |
| 0660 201 A2 | 6/1995 | European Pat. Off. . |
| 072 072 A2 | 7/1996 | European Pat. Off. . |
| 0 743 572 A1 | 11/1996 | European Pat. Off. . |

OTHER PUBLICATIONS

E. Bassous, et al., "The Fabrication of High Precision Nozzles by the Anisotropic Etching of (100) Silicon", *J. Electrochem. Soc.: Solid–State Science and Technology*, vol. 125. No. 8, Aug. 1978. pp. 1321–1327.

Jerome Johnson. "An Etched Circuit Aperture Array for Toner Jet® Printing", *IS&T's Tenth International Congress on Advances in Non–Impact Printing Technologies*, 1994, pp. 311–313.

"The Best of Both Worlds," Brochure of Toner Jet® by Array Printers, *The Best of Both Worlds*, 1990.

*Primary Examiner*—John Barlow
*Assistant Examiner*—Raquel Yvette Gordon
*Attorney, Agent, or Firm*—Knobbe, Martens, Olson & Bear, LLP

[57] ABSTRACT

A direct electrostatic printing method and apparatus decrease the adhesion force of toner particles on a toner particle source. The method includes the steps of coating the toner particle source with a plurality of layers of toner particles and vibrating the toner particle source so that the toner particles break up to form one fluidised layer of toner. The toner particle supply apparatus includes a toner feed source supplying toner particles to a rotating developer sleeve to form a multilayer coating of toner particles on the developer sleeve. A vibration generating device is arranged adjacent to, or on a surface of the developer sleeve to break up the toner particles to form one fluidised layer of toner.

10 Claims, 3 Drawing Sheets

U.S. PATENT DOCUMENTS

| | | |
|---|---|---|
| 5,036,341 | 7/1991 | Larsson . |
| 5,038,159 | 8/1991 | Schmidlin et al. . |
| 5,057,855 | 10/1991 | Damouth . |
| 5,072,235 | 12/1991 | Slowik et al. . |
| 5,083,137 | 1/1992 | Badyal et al. . |
| 5,095,322 | 3/1992 | Fletcher . |
| 5,121,144 | 6/1992 | Larson et al. . |
| 5,128,695 | 7/1992 | Maeda . |
| 5,148,595 | 9/1992 | Doggett et al. . |
| 5,170,185 | 12/1992 | Takemura et al. . |
| 5,181,050 | 1/1993 | Bibl et al. . |
| 5,204,696 | 4/1993 | Schmidlin et al. . |
| 5,204,697 | 4/1993 | Schmidlin . |
| 5,214,451 | 5/1993 | Schmidlin et al. . |
| 5,229,794 | 7/1993 | Honman et al. . |
| 5,235,354 | 8/1993 | Larson . |
| 5,237,346 | 8/1993 | Da Costa et al. . |
| 5,256,246 | 10/1993 | Kitamura . |
| 5,257,045 | 10/1993 | Bergen et al. . |
| 5,270,729 | 12/1993 | Stearns . |
| 5,274,401 | 12/1993 | Doggett et al. . |
| 5,307,092 | 4/1994 | Larson . |
| 5,329,307 | 7/1994 | Takemura et al. . |
| 5,374,949 | 12/1994 | Wada et al. . |
| 5,386,225 | 1/1995 | Shibata . |
| 5,402,158 | 3/1995 | Larson . |
| 5,414,500 | 5/1995 | Furukawa . |
| 5,446,478 | 8/1995 | Larson . |
| 5,450,115 | 9/1995 | Bergen et al. . |
| 5,453,768 | 9/1995 | Schmidlin . |
| 5,473,352 | 12/1995 | Ishida . |
| 5,477,246 | 12/1995 | Hirabayashi et al. . |
| 5,477,250 | 12/1995 | Larson . |
| 5,506,666 | 4/1996 | Masuda et al. . |
| 5,508,723 | 4/1996 | Maeda . |
| 5,515,084 | 5/1996 | Larson . |
| 5,526,029 | 6/1996 | Larson et al. . |
| 5,558,969 | 9/1996 | Uyttendaele et al. . |
| 5,559,586 | 9/1996 | Wada . |
| 5,600,355 | 2/1997 | Wada . |
| 5,614,932 | 3/1997 | Kagayama . |
| 5,617,129 | 4/1997 | Chizuk, Jr. et al. . |
| 5,625,392 | 4/1997 | Maeda . |
| 5,640,185 | 6/1997 | Kagayama . |
| 5,650,809 | 7/1997 | Kitamura . |
| 5,666,147 | 9/1997 | Larson . |
| 5,677,717 | 10/1997 | Ohashi . |
| 5,708,464 | 1/1998 | Desie . |
| 5,774,159 | 6/1998 | Larson . |
| 5,805,185 | 9/1998 | Kondo . |
| 5,818,480 | 10/1998 | Bern et al. . |
| 5,818,490 | 10/1998 | Larson . |
| 5,847,733 | 12/1998 | Bern . |

FOREIGN PATENT DOCUMENTS

| | | |
|---|---|---|
| 0752 317 A1 | 1/1997 | European Pat. Off. . |
| 0764 540 A2 | 3/1997 | European Pat. Off. . |
| 12 70 856 | 6/1968 | Germany . |
| 26 53 048 | 5/1978 | Germany . |
| 4426333 | 11/1969 | Japan . |
| 55-55878 | 4/1980 | Japan . |
| 55-84671 | 6/1980 | Japan . |
| 55-87563 | 7/1980 | Japan . |
| 56-89576 | 7/1981 | Japan . |
| 58-044457 | 3/1983 | Japan . |
| 58-155967 | 9/1983 | Japan . |
| 62-248662 | 10/1987 | Japan . |
| 62-13356 | 11/1987 | Japan . |
| 01120354 | 5/1989 | Japan . |
| 05220963 | 8/1990 | Japan . |
| 04189554 | 8/1992 | Japan . |
| 4-268591 | 9/1992 | Japan . |
| 4282265 | 10/1992 | Japan . |
| 53-08518 | 8/1993 | Japan . |
| 93331532 | 12/1993 | Japan . |
| 94200563 | 8/1994 | Japan . |
| 9048151 | 2/1997 | Japan . |
| 09118036 | 5/1997 | Japan . |
| 2108432 | 5/1983 | United Kingdom . |
| 9014960 | 12/1990 | WIPO . |
| 9201565 | 2/1992 | WIPO . |

DIRECT PRINTING METHOD WITH IMPROVED CONTROL FUNCTION

TECHNICAL FIELD

The present invention relates to a direct electrostatic printing method, in which toner particles are released from a toner particle source for further transport to an image receiving medium.

BACKGROUND OF THE INVENTION

A form of electrostatic printing is one that has come to be known as direct electrostatic printing (DEP). With this method, toner particles are deposited in image configuration directly onto an image receiving medium, such as plain paper or any type of intermediate print media. A local electric field is applied between a toner source and a printhead structure. The electric field will induce a force on the toner particles which is proportional to the charge of the individual toner particles. If the electrically induced force exceeds the adhesion force, which depends on the charge of the toner particle, between the toner particle and the toner source the toner particle will be lifted off the toner source surface and accelerated towards the printhead structure. DEP printing allows simultaneous field imaging and toner transport to produce a visible image on paper directly from computer generated signals without the need for those signals to be intermediately converted to another form of energy such as light energy as is required in electrophotographic printing.

A DEP printing device has been disclosed in U.S. Pat. No. 3,689,935, issued Sep. 5, 1972 to Pressman et al.

Pressman et al. discloses a multilayered particle flow modulator comprising a continuous layer of conductive material, a segmented layer of conductive material and a layer of insulating material interposed therebetween. An overall applied field projects toner particles through apertures arranged in the modulator whereby the particle stream density is modulated by an internal field applied within each aperture.

A new concept of direct electrostatic printing was introduced in U.S. Pat. No. 5,036,341, granted to Larson, and further developed in a co-pending application.

According to Larson, a uniform electric field is produced between a back electrode and a developer sleeve coated with charged toner particles. A printhead structure, such as a control electrode matrix, is interposed in the electric field and utilized to produce a pattern of electrostatic fields which, due to control in accordance with an image configuration, selectively open or close passages in the printhead structure, thereby permitting or restricting the transport of toner particles from the developer sleeve toward the back electrode. The modulated stream of toner particles allowed to pass through the opened passages impinges upon an image receiving medium, such as paper, interposed between the printhead structure and the back electrode.

According to the above method, a charged toner particle is held on the developer surface by adhesion forces which are essentially proportional to $Q^2/d^2$, where d is the distance between the toner particle and the surface of the developer sleeve and Q is the particle charge. The electric force required for releasing a toner particle from the sleeve surface is chosen to be sufficiently high to overcome the adhesion forces.

However, due to variations in toner particle charge, particle size and particle layer thickness, the particles are not uniformly accelerated from the developer sleeve, resulting in a relatively long train of toner particles leaving the developer sleeve and being transported towards the printhead structure. Thus, toner particles exposed to the electric field through an opened aperture are neither simultaneously released from the developer surface nor uniformly accelerated toward the back electrode. As a result, the time period from that the first particle is released until all released particles are deposited onto the image receiving medium is relatively long.

As described above, a continuous voltage signal is utilized to modulate a stream of toner particles through a pattern of apertures, opening or closing apertures during predetermined time periods (development periods) during which toner is released from the toner particle source and transported through the opened apertures to the back electrode and the image receiving medium, eg. a paper sheet. When utilizing a continuous control signal (e.g.+300 V) during a specific time period, an amount of particles is released from the particle source and exposed to an attraction force from the back electrode electromagnetic field. Particles which have gained sufficient momentum to pass through the aperture before the end of the time period are still influenced by the control signal even after passage through the aperture and are thus exposed to a divergent electromagnetic field, which may cause scattering of the toner particles. On the other hand, particles passing through the aperture immediately after the end of the time period are, during their transport from the aperture towards the back electrode, subjected to a more convergent field which provides more focused transport trajectories and thereby smaller dots. This first state prolongs the time of transport to the back electrode and also elongates the stream of toner particles, which leads to a delayed deposition on the image receiving medium and thus a lower print uniformity at lower speeds. The toner stream is also scattered, which results in larger dots and hence a lower print resolution.

This drawback is particularly critical when using dot deflection control. Dot deflection control consists of performing several development steps during each print cycle to increase print resolution. For each development step, the symmetry of the electrostatic field is modified in a specific direction, thereby influencing the transport trajectories of toner particles toward the image receiving medium. This allows several dots to be printed through each single passage during the same print cycle, each deflection direction corresponding to a new dot location. To enhance the efficiency of dot deflection control, it is particularly essential to decrease the toner transport time and to ensure direct transition from one deflection direction to another, without delayed toner deposition. For example, a 600 dpi (dots per inch) deflection control requires a dot diameter below 60 microns and high speed, eg. 10 ppm (pages per minute); dot deflection printing requires shorter toner transport time and faster transition. It is thus essential to ensure that all toner particles released from the toner source are given enough time for all toner particles to be deposited onto the image receiving medium before a transition is made from one deflection direction to another.

Therefore, in order to achieve higher speed printing with improved print uniformity, and in order to improve dot deflection control, there is still a need to improve DEP methods to allow shorter toner transport time and reduce delayed toner deposition and also lower the consumption of toner per development time unit.

SUMMARY OF THE INVENTION

The present invention satisfies a need for improved DEP methods by subjecting the surface on which the toner particles are held by adhesion forces, stemming from their electric charge, to vibrations. These vibrations reduce the adhesion forces and improve the release properties of the toner particles when they are subjected to an electromagnetic toner transport field. A toner particle source is thus coated with a multilayer coating of toner particles and the multilayer coating of toner particles is subjected to vibrations so that the multilayer coating breaks up into one fluidised layer.

The vibrations may be created using different techniques. For example, induced by a high frequency air pressure, or induced by a piezoelectric, magnetomechanic or magnetostrictive actuator. The vibrations are advantageously within the frequency range of 10 to 1000 kHz. The toner particle source may be of several types, for example, sleeve or belt construction or combinations of both. The actuator or inducer may operate directly or indirectly on the toner particle source.

The present invention thus satisfies a need for improved DEP methods by providing high-speed transition from print conditions to non-print conditions and shorter toner transport time with a more convergent toner particle stream, thereby allowing smaller dot sizes to be printed. This results in an improved possibility to control the dot size, i.e. to modulate the dot stream convergence, which is essential when using dot deflection printing methods. Smaller dot sizes make it possible to reach higher print addressability. For example, a 600 dpi printing resolution requires 1/600 inch dot diameter, or about 42 microns, to make it possible to distinguish between two adjacent dots. Typical apertures in a printhead structure have a diameter of about 140 microns, which implies that it is necessary to focus the toner particle stream.

The present invention further satisfies high speed transition from one deflection direction to another, and thereby improved dot deflection control.

A DEP method in accordance with the present invention is advantageously performed in consecutive print cycles, each of which includes at least one development period $t_b$ and at least one recovery period $t_w$ subsequent to each development period $t_b$. A pattern of variable electrostatic fields is produced during at least a part of each development period ($t_b$) to selectively permit or restrict the transport of charged toner particles from a particle source toward a back electrode and an electric field is produced during at least a part of each recovering period ($t_w$) to repel a part of the transported charged toner particles back toward the particle source.

A DEP method in accordance with the present invention preferably includes the steps of:

providing a particle source, a back electrode and a printhead structure positioned therebetween, said printhead structure including an array of control electrodes connected to a control unit;

positioning an image receiving medium between the printhead structure and the back electrode;

producing ultrasonic vibration on a surface on which toner particles adhere to thereby cause the particles to vibrate, whereby the toner particle layer on the surface assumes a fluid state, thereby reducing the adhesion forces between the toner particles and the surface;

producing an electric potential difference between the particle source and the back electrode to apply an electric field which enables the transport of charged toner particles from the particle source toward the back electrode; and during each development period $t_b$, applying variable electric potentials to the control electrodes to produce a pattern of electrostatic fields which, due to control in accordance with an image configuration, open or close passages/apertures through the printhead structure to selectively permit or restrict the transport of charged particles from the particle source onto the image receiving medium.

Other objects, features and advantages of the present invention will become more apparent from the following description when read in conjunction with the accompanying drawings in which preferred embodiments of the invention are shown by way of illustrative examples.

BRIEF DESCRIPTION OF THE DRAWINGS

Although the examples shown in the accompanying drawings illustrate a method wherein toner particles have negative charge polarity, this method can be performed with particles having positive charge polarity without departing from the scope of the present invention. In this case, all potential values will be given the opposite sign.

DETAILED DESCRIPTION OF PREFERRED EMBODIMENTS

In classic designs of developer systems, a toner particle source is preferably arranged on a rotating developer sleeve having a substantially cylindrical shape and a rotation axis extending parallel to a printhead structure. The sleeve surface is coated with a relatively thin layer of charged toner particles from a toner feed source. The toner particles are held on the sleeve surface by adhesion forces due to charge interaction with the sleeve material. The toner particles thus rest on and are adhered to the surface of the developer sleeve. Several layers of toner particles may be present, each layer consisting of toner particles having different dielectric constants and electric properties. The adhesion forces have different strengths depending on the size, electric charge, etc. of the toner particles. The developer sleeve is preferably made of metallic material; however a flexible, resilient material is preferred for some applications. The toner particles are generally non-magnetic particles having negative charge polarity and a narrow charge distribution in the order of about 4 to 10 $\mu$C/g.

An alternative to a developer sleeve may be a belt developer system where a driver roll rotates a toner particle transport belt which slides over a smooth roll having a large radius in a printzone.

The toner particle source is coated with a multilayer coating of toner particles and this multilayer coating of toner particles is subjected to vibrations so that the multilayer coating breaks up into one fluidised layer. The vibrations are advantageously within the frequency range 10 to 1000 kHz, for example ultrasonic vibrations.

Figure 1:
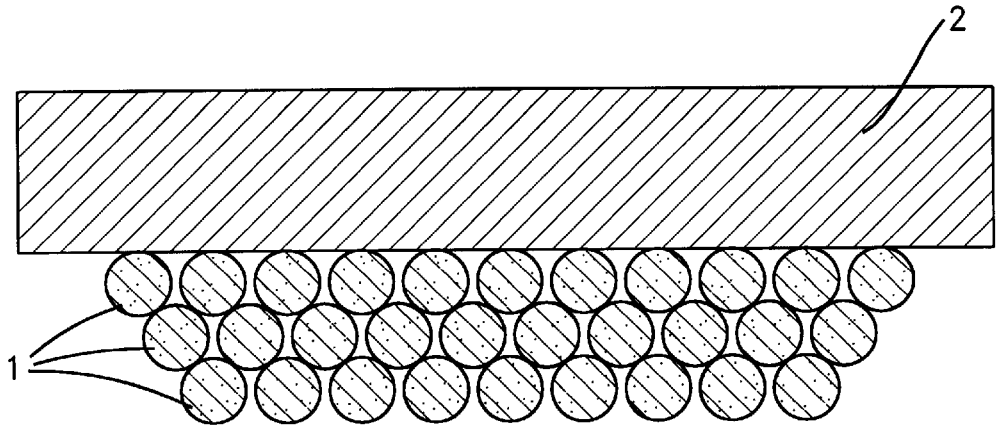
FIG. 1 is a schematic sectional view showing a multilayered coating of toner particles on an actuator which is situated on or near a toner particle source surface.

FIG. 1 shows a multiple layer of toner particles 1 adhering to a toner particle source surface. A source 2 of vibration is arranged immediately on the toner particle source surface.

Figure 2:
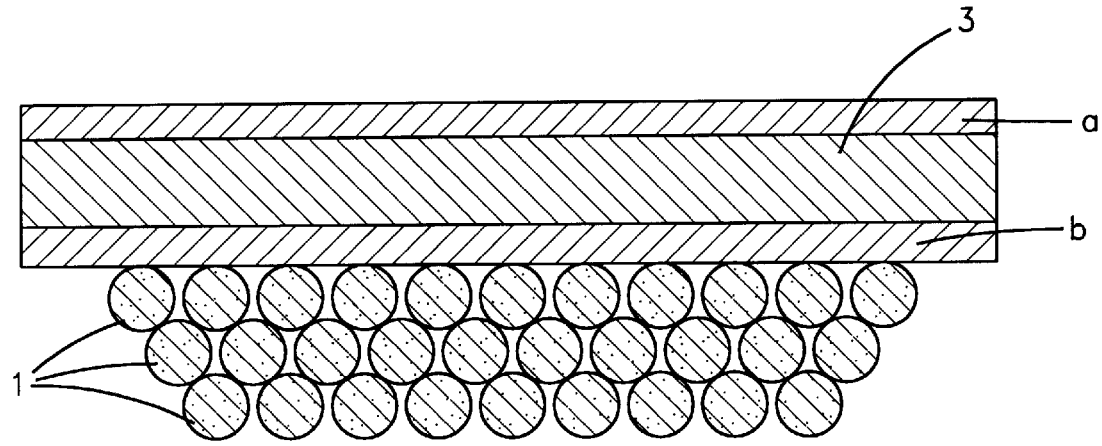
FIG. 2 is a schematic sectional view showing a multilayered coating of toner particles on a laminar actuator.

In FIG. 2, a laminar actuator is described where the active material 3 is sandwiched between two electrodes a and b. The operation of the active material may be controlled by an electric signal applied to a and b.

Figure 3:
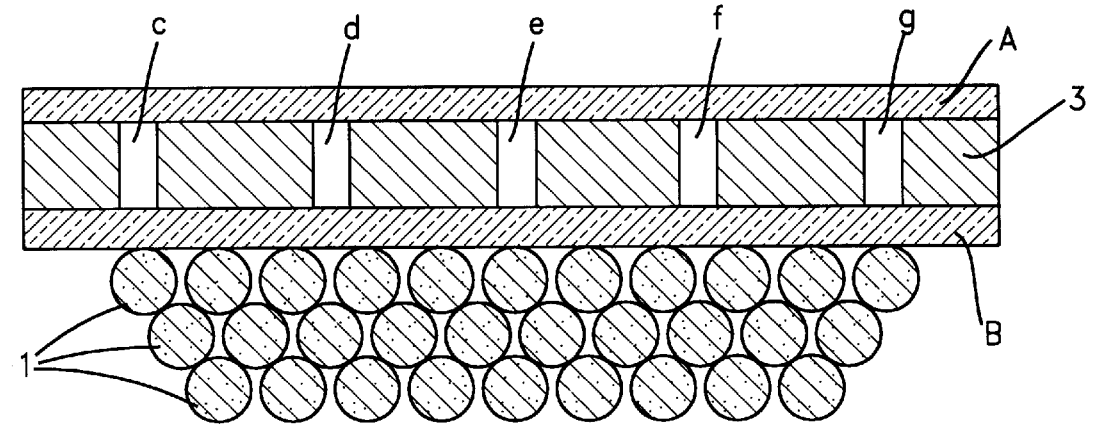
FIG. 3 is a schematic sectional view of an axially segmented actuator.

FIG. 3 shows a segmented actuator where the active material 3 is sandwiched between two insulators A and B. Control electrodes c, d, e, f and g are arranged between the insulators A and B so that the active material is divided into a plurality of segments. This construction facilitates the control of the vibration distribution, i.e. the vibrations can be applied to different areas of the toner source surface.

Figure 4:
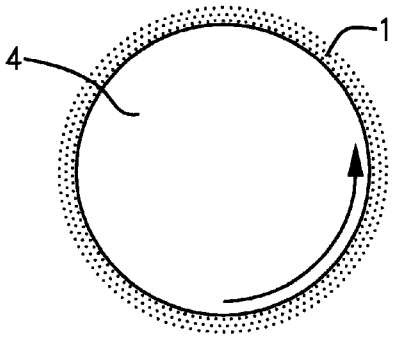
FIG. 4 is schematic sectional view of a developer sleeve having an actuating surface layer.

In FIG. 4, a schematic developer sleeve 4 is depicted having a multilayer coating of toner particles 1 thereon.

Figure 5:
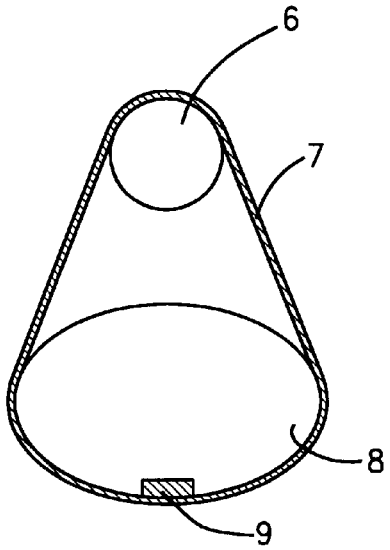
FIG. 5 is a schematic sectional view showing an actuator in a belt developer system.

FIG. 5 describes a general design of a belt developer system where a driver roll 6 rotates a toner particle transport belt 7. The belt slides over a smooth roll 8 having a large radius in a printzone. A vibration source 9 is arranged on the surface of the smooth roll.

Figure 6:
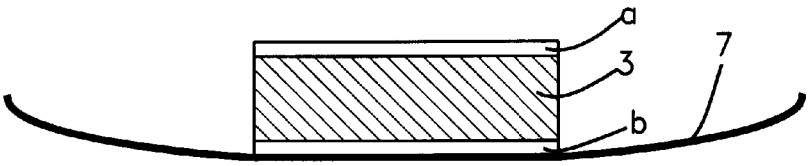
FIG. 6 is a schematic sectional view of a laminar actuator used in a belt developer system according to FIG. 5.
Figure 7:
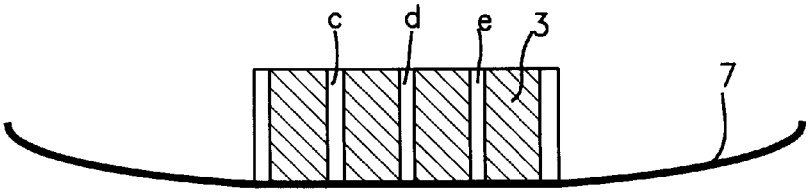
FIG. 7 is a schematic sectional view of an axially segmented actuator used in a belt developer system according to FIG. 5.

FIGS. 6 and 7 correspond to FIGS. 2 and 3, but represent the belt drive system according to FIG. 5.

Figure 8:
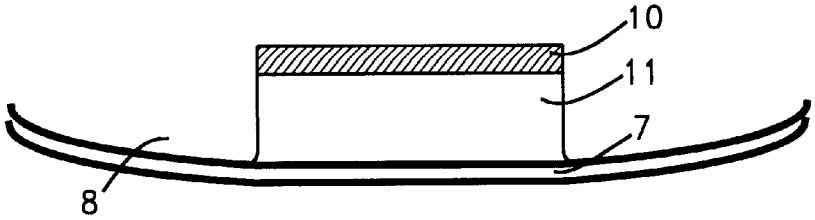
FIG. 8 is a schematic sectional view showing an actuator in a chamber in a belt developer system.

In FIG. 8, an alternative embodiment to the earlier described solid vibration actuators is described. A vibration transmitter 10 operates in a chamber 11 of the smooth roll 8. The vibrations generated in the chamber make the belt 7 vibrate.

Figure 9:
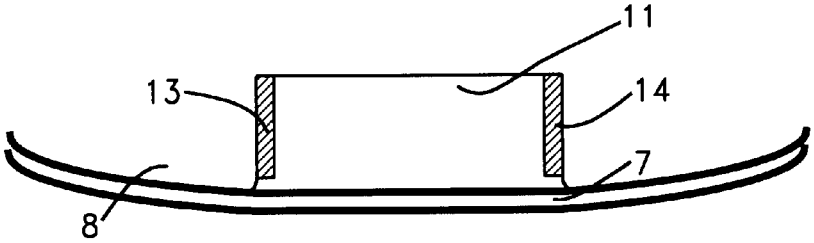
FIG. 9 is a schematic sectional view showing a further embodiment of an actuator in a chamber in a belt developer system.

FIG. 9 shows a further alternative embodiment along the same principles as shown in FIG. 8, but here a first 13 and a second 14 vibration transmitter are arranged in the chamber 11, creating the air pressure needed to make the belt 7 vibrate.

All embodiments incorporating vibration transmitters have electric signal control devices which feed electric signals to the transmitters to produce the vibrations.

Figure 10:
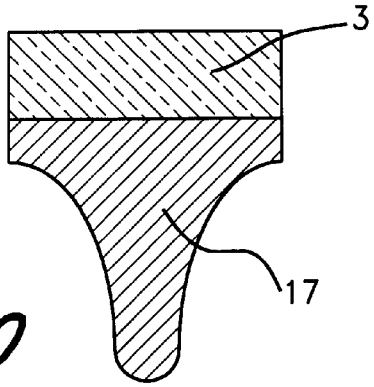
FIG. 10 is a schematic sectional view of an actuator with a transducer.
Figure 11:
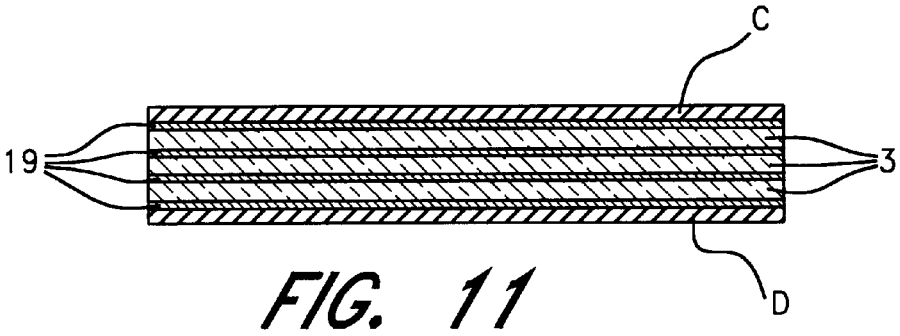
FIG. 11 is a schematic sectional view of a laminar actuator having a multilayer of active material.

In cases where a sufficient vibration amplitude cannot be obtained using vibration transmitters as described above, amplitude amplifiers, also called transducers or horns, may be used. An embodiment of a transducer is shown in FIG. 10. The active material 3 is coupled to a transducer 17. This transducer construction may be used in any of the preceding embodiments of the invention.

To enhance the output of the vibration device, for example if the available driver circuits limit the maximum available output, a laminar actuator having a sandwich of a plurality of layers of active material 3 separated by electrodes 19 may be used. The laminar actuator is protected by two layers of insulating material depicted as C and D, respectively.

The invention is not limited to the descriptions above nor to the examples shown on the drawings, but may be varied within the scope of the appended claims.

What is claimed is:

1. A direct electrostatic printing method for decreasing adhesion force of toner particles on a toner particle source that provides toner particles to an image receiving medium through a control electrode array positioned between said toner particle source and said image receiving medium, the method comprising the steps of:

coating said toner particle source with a plurality of layers of toner particles; and vibrating said toner particle source so that said plurality of layers of toner particles breaks up to form one fluidised layer of toner on said toner particle source.

2. The direct electrostatic printing method of claim 1, wherein said toner particle source is vibrated at a frequency in the range of 10 kHz to 1000 kHz.

3. A toner particle supply apparatus which provides toner particles to an image receiving medium through an array of control electrodes positioned between said toner particle supply apparatus and said image receiving medium, the toner particle supply apparatus comprising:

a toner feed source that supplies toner particles to a rotating developer sleeve to form a multilayer coating on said developer sleeve; and a vibration generating device arranged on a surface of said developer sleeve to vibrate said developer sleeve and break up said multilayer coating of toner particles to form one fluidised layer of toner on said developer sleeve.

4. The toner particle supply apparatus of claim 3, wherein said vibration generating device generates vibrations having a frequency in the range of 10 kHz to 1000 kHz.

5. A toner particle supply apparatus which provides toner particles to an image receiving medium through an array of control electrodes positioned between said toner particle supply apparatus and said image receiving medium, the toner particle supply apparatus comprising:

a toner feed source that supplies toner particles to a rotating developer sleeve to form a multilayer coating on said developer sleeve; and a vibration generating device arranged adjacent to a surface of said developer sleeve to vibrate said developer sleeve and break up said multilayer coating of toner particles to form one fluidised layer of toner on said developer sleeve.

6. The toner particle supply apparatus of claim 5, wherein said vibration generating device generates vibrations having a frequency in the range of 10 kHz to 1000 kHz.

7. A toner particle supply apparatus which provides toner particles to an image receiving medium through an array of control electrodes positioned between said toner particle supply apparatus and said image receiving medium, the toner particle supply apparatus comprising:

a toner feed source;

a driver roller for rotating a toner particle transport belt, said toner feed source supplying toner particles to said transport belt to form a multilayer coating of toner particles on said transport belt;

a smooth roll having a large radius in a printzone, said smooth roll transporting said transport belt through said printzone; and a vibration generating device arranged on a surface of said smooth roll to vibrate said smooth roll and said transport belt to break up said multilayer coating of toner particles to form one fluidised layer of toner on said transport belt.

8. The toner particle supply apparatus of claim 7, wherein said vibration generating device generates vibrations having a frequency in the range of 10 kHz to 1000 kHz.

9. A toner particle supply apparatus which provides toner particles to an image receiving medium through an array of control electrodes positioned between said toner particle supply apparatus and said image receiving medium, the toner particle supply apparatus comprising:

a toner feed source;

a driver roller for rotating a toner particle transport belt, said toner feed source supplying toner particles to said transport belt to form a multilayer coating of toner particles on said transport belt;

a smooth roll having a large radius in a printzone, said smooth roll transporting said transport belt through said printzone; and a vibration generating device arranged adjacent to a surface of said smooth roll to vibrate said smooth roll and said transport belt to break up said multilayer coating of toner particles to form one fluidised layer of toner on said transport belt.

10. The toner particle supply apparatus of claim 9, wherein said vibration generating device generates vibrations having a frequency in the range of 10 kHz to 1000 kHz.

* * * * *